United States Patent [19]

Rauterberg

[11] 4,195,276

[45] Mar. 25, 1980

[54] ELECTROMAGNETIC RELAY AND METHOD FOR ITS ADJUSTMENT

[75] Inventor: Ulf Rauterberg, Munich, Fed. Rep. of Germany

[73] Assignee: Siemens Aktiengesellschaft, Berlin & Munich, Fed. Rep. of Germany

[21] Appl. No.: 868,980

[22] Filed: Jan. 12, 1978

[30] Foreign Application Priority Data

Jan. 13, 1977 [DE] Fed. Rep. of Germany ..... 2701230

[51] Int. Cl.[2] ..... H01H 51/27

[52] U.S. Cl. ..... 335/151; 29/622; 335/86

[58] Field of Search ..... 335/151, 86, 212, 298, 335/67, 80, 81, 96, 132, 155, 176, 194, 154; 29/155.5

[56] References Cited

U.S. PATENT DOCUMENTS

| | | | |
|---|---|---|---|
| 3,242,557 | 3/1966 | Ellwood | 335/151 |
| 3,477,045 | 11/1969 | Sauer | 335/151 |
| 3,579,158 | 5/1971 | Kutyla | 335/151 |
| 3,587,011 | 6/1971 | Kurz | 335/151 |
| 3,711,749 | 1/1973 | Koblents et al. | 335/151 |
| 4,063,203 | 12/1977 | Fujiwara et al. | 335/151 |

*Primary Examiner*—Harold Broome

*Attorney, Agent, or Firm*—Hill, Van Santen, Steadman, Chiara & Simpson

[57] ABSTRACT

A magnetically adjustable relay which may have a sealed contact system is disclosed wherein the switching element is affixed to an elongated ferromagnetic adjusting plate. The adjusting plate is deformable under influence of an applied external magnetic field to provide for adjustment of the switching element. In disclosed embodiments the adjusting plate may be provided with a designated bending point.

14 Claims, 7 Drawing Figures

ELECTROMAGNETIC RELAY AND METHOD FOR ITS ADJUSTMENT

BACKGROUND OF THE INVENTION

1. Field of the Invention

This invention relates to relays and more particularly to a method and apparatus for adjusting the contact system of such a relay.

2. Prior Art

This invention is directed to that type of electromagnetic relay which has a switching element which is mounted at one end and which is elastic or resilient such that its free end can move to cooperate with at least one other switching member to effectuate a contact. Such a switching element can, for example, be a contact tongue, an arm, an armature, a contact spring or an armature contact or any other known variant. In addition the invention is directed to a method of adjusting such a relay.

Most electromagnetic relays have an operating air gap. In such relays adjustment of the air gap is provided either in the magnetic circuit or in the contact spacing between the contact providing parts during the production of the relay. This adjustment is required in order to avoid large variations in the operating values of the relays. Such an adjustment has been known to be provided by means of adjusting screws or by means of controlled bending of the sheet metal parts with the aid of adjusting clamps. Such adjustment operations require painstaking care and manual dexterity and cannot generally be automated . During the course of miniaturizing such relays, the adjusting problem has been aggravated due to the fact that, frequently, the parts to be adjusted are often accessible to the adjusting tools only with great difficulty. Further in conventional miniature sealed relays wherein the contact system is internally sealed, adjustment after assembly can be virtually impossible particularly where it is required that adjustment tools be given access to the components to be adjusted.

An adjustable miniature relay is illustrated in U.S. Pat. No. 3,477,045. In such a type of relay, subsequent adjustment is thought to be provided for by means of an adjustment spring device in cooperation with screws in the casing wall. However such a device does not provide a complete solution to the problem since the adjusting mechanism is not only very expensive but is no longer functionable after completion of the final sealing of the adjustment member.

It has also been suggested, in connection with contact relays having a ferromagnetic switching tongue received in a glass casing, to subsequently deform the tongue by means of a magnetic field applied from the exterior. See for example U.S. Pat. No. 3,242,557. However the bending of a spring tongue which abuts an opposing contact requires an extremely high magnetic force. Thus, desired adjustment cannot be readily obtained. Further the contact force cannot be adjusted independently from the contact spacing and an initial grid potential vis-a-vis opposed rigid contacts cannot be obtained with this known method.

SUMMARY OF THE INVENTION

It is therefore a primary objective of this invention to construct an electromagnetic relay of the above described types such that the contact switching element can be adjusted to arbitrary values in both switching directions even though the switching element to be adjusted is positioned interiorly of a sealed casing or housing.

This primary objective is resolved in this invention by attaching the switching element through its elastic support to an elongated ferromagnetic adjusting plate which is bendable about a point of attachment to the relay body.

The adjusting plate is used as a carrier for the switching rod or arm and can be bent through the use of a magnetic field applied from the exterior. This is particularly advantageous when used in connection with hermetically sealed armatures or contact rods or arms. The switching arm or element can, itself, be fashioned as a spring member or can be supported in an elastic fashion. The spring switching element is not, itself, deformed during the adjusting process. Rather the adjusting plate which functions as a carrier for the spring element is bent during the adjusting process to alter the position of the point of attachment of the elastic element to the adjusting plate, thus effecting the elastic element. The free end of the elastic member (switching rod or arm), can be arbitrarily prestressed by this method vis-a-vis an anti-pole device or an opposed contact as only the switching rod or elastic element and not the adjusting plate which is bent, abuts the counter buffer or dog.

In one embodiment of the invention the adjusting plate is positioned parallel to the elastic member such that the elastic member, which functions as a switching member, is mounted to the adjusting plate in the proximity of the adjusting plate - relay body clamp point. In another embodiment the switching member can be elastically supported at its free end in alignment with the adjusting plate. The adjusting plate also preferably is provided with a theoretical bending point between its clamping point and the point of mounting of the switching member. The theoretical bending point can be formed by a weakness in the cross section of the adjusting plate. In this manner the magnetic forces necessary for adjustment can be relatively low.

The material of the adjusting plate is advantageously soft iron or a similar material which has a spring bending limit which lies in approximately the same range. The switching element or elastic element can itself be arbitrarily selected in accordance with other requirements. Thus, if the switching element is a contact rod it can be formed of an elastic contact material or, if it is an armature, can be formed of a ferromagnetic material.

The invention is therefore not limited by the material of the switching element and, for example the switching element could be an elastic armature contact arm or rod which is electrically and magnetically conductive, or, in another case, it could be a rigid armature mounted through an armature support such as a spring. The switching member can be positioned as an armature contact located within the coil of the relay and, for example, may be used in such a position where the coil member forms a hermetically sealed switching chamber. Adjustment in all such cases can be carried out on the completely mounted, sealed, and possibly even cast relay, by use of this invention.

It is therefore a primary object of this invention to provide an improved adjustable relay.

It is another, and more particular object of this invention to provide a relay having a switching arm or element whose attitude is adjustable by means of a bendable adjustment plate attached to the switching arm or element.

It is another object of this invention to provide a relay having a switching element, the position of which can be adjusted by means of the application of an external magnetic force acting upon a bendable adjustment plate carrying the switching element.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENT

Figure 1:
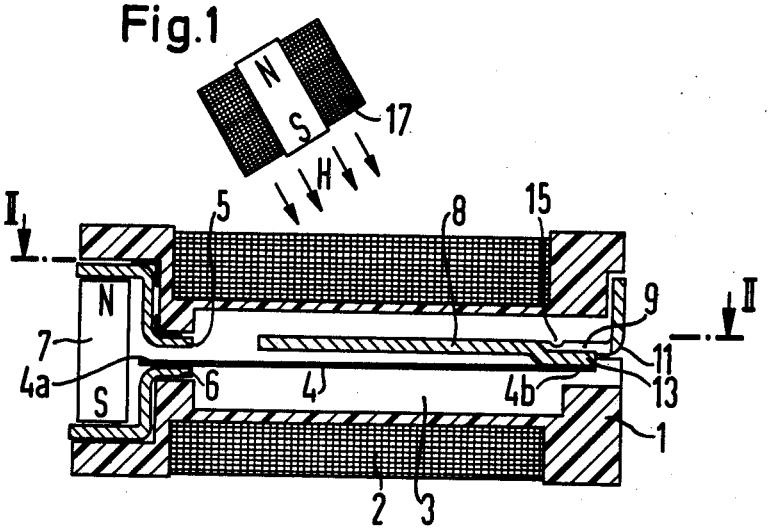
FIG. 1 is a longitudinal sectional view of a relay according to this invention taken along the lines I—I of FIG. 2.
Figure 2:
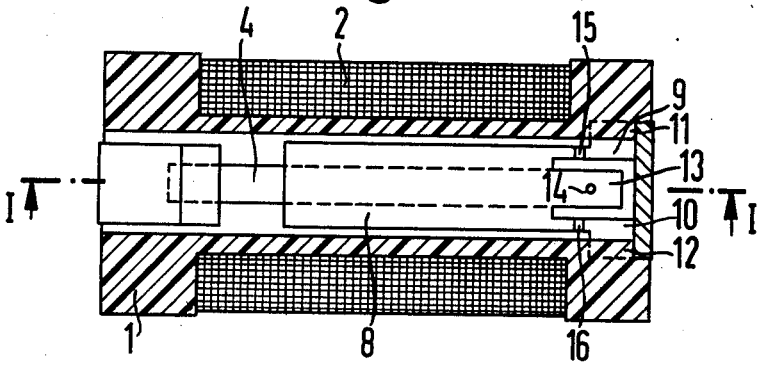
FIG. 2 is a view similar to FIG. 1 taken along the lines II—II of FIG. 1.

FIG. 1 illustrates, in cross section, an electromagnetic armature contact relay. The relay includes a coil body 1 which functions as carrier for the magnet system. The body carries a coil winding 2 and defines a switching chamber 3 interior of the coil body. A ferromagnetic spring rod or arm 4 extends substantially axially of the coil body and is of the type which will execute switching movements between pole shoes 5 and 6 with its free end 4*a* being used as an armature contact. A permanent magnet 7 is positioned between outer ends of the pole shoes 5 and 6. The permanent magnet is so positioned that, in dependence upon the current direction in the coil 2, the switching element 4 will be attracted to one or the other of the pole shoes. The pole shoes 5 and 6 may therefore be used both as electrically opposite contacts and as an attractor element. The electrical connections are not illustrated in the schematic views of FIGS. 1 and 2 but will be apparent to those skilled in the art.

In order to provide for adjustability of the positioning of the switching element 4, its mounting end 4*b* is not directly clamped in the coil body. Rather the mounting end 4*b* is attached to an adjusting plate 8. The plate 8 extends essentially parallel to the switching element 4 and is formed of a ferromagnetic material having a low spring bending limit. The adjusting plate 8, in the embodiment illustrated,has spaced bridge connections at 9 and 10 which are clamped to the coil body 1. In order to provide fastening, in the illustrated embodiment, the coil body is provided with notches 11 and 12 extending parallel to the axis and located on opposite sides of the switching chamber 3. The bridges 9 and 10 are receivable in the notches 11 and 12 thereby seating and suspending the adjusting plate within the switching chamber 3. A tab 13 of the adjusting plate, cut from the adjusting plate, projects freely between the bridges 9 and 10 in substantially parallel spaced relationship thereto. The swtiching element 4 is attached to the tab by means such as point soldering as at 14.

In order to provide for easy adjustment of the adjusting plate the bridges 10 and 11 have weakened portion 15 and 16 providing a theoretical bending point. The weakened portions 15 and 16 lie outside of the portions of the bridges 9 and 10 which are enclamped in the coil body 1 such that the adjusting plate is bendable about the position of enclampment of the adjustment plate at the weakened points 15 and 16. Because the adjusting plate is constructed of a ferromagnetic material, it will be appreciated that it can be caused to move and therefore be bent around the bending points 15 and 16 by the application of an externally applied magnetic field of relatively small strength.

During the process of bending the adjusting plate 8, the mounting point 14 of the switching element 4 will be slightly moved whereby the position of the free end 4*a* of the switching element can be adjusted. For example, dependent upon the desired adjustment, the free end can abut, with more or less grid potential, one or the other of the anti-poles 5 or 6, or can be centrally positioned with respect thereto.

The adjusting plate 8 and the switching element 4 are sufficiently independent from one another that, in view of the stiffness of the switching element 4, an additional deflection of the adjusting plate is permitted even when the switching element 4 abuts one of the pole plates 5 or 6.

The adjusting plate 8 is bent through the application of a magnetic field which may be applied from the exterior of the relay by means such as, for example, coil 17. A torque will obviously be exerted upon an elongated ferromagnetic member whose longitudinal axis forms an angle between zero and 90° with respect to the flux lines of the magnetic field. When this occurs, the ferromagnetic part will attempt to rotate its axis in the direction of the lines of flux. Such a ferromagnetic part, in the instant example, the adjusting plate, will be magnetized in a longitudinal direction by means of the magnetic field and will have the effect of a dipole. Its magnetic moment is $p=I\cdot V$. In this formula I represents the magnetization and V the volume.

In a dipole having the magnetic movement p which lies at an angle $\alpha$ with the flux lines having a field force H, a torque in the amount $D=p\cdot H\cdot \sin \alpha$ occurs.

When the component is unilaterally clamped, the torque corresponds with a force, effective vertically to the greatest area of the adjusting plate (having a length 1), as $F_h=D/1$.

Thus, the torque will be dependent upon the sine of the angle between the adjusting plate to be bent and the magnetic lines of flux. However since magnetization of the adjusting plate cannot result at an angle $\alpha$ of 90°, the angle has to be selected smaller than 90°. An optimum torque results, in practice, at an angle which is up to 15° less than 90°, that is from 75° to 90°.

In addition to the directional effect of the homogenous magnetic field, the force can be utilized for magnetic adjustment by seeking to move a ferromagnetic part in the direction of the increasing field strength of the inhomogenous magnetic field. This has the effect of attraction of the pole shoes. This additionally occurring force is approximately $F_i'=I\cdot\cos\cdot dH/ds$.

As this force effects the flux line direction, it should be multiplied by sine $\alpha$ in order to obtain the component which acts vertically to the adjusting plate. This force acts at the center of gravity. Therefore when one end of the component is clamped, i.e. a unilateral clamping, the comparison force acting in the direction of the end of the adjusting plate is obtained by multiplying by ½: $F_i' = \frac{1}{2} I \cdot dH/ds \cdot \cos\alpha \cdot \sin\alpha$.

Adjustment of a relay such as the relay illustrated in FIG. 1 can be made prior to the assembly of the permanent magnet. In such an adjustment method, position of the spring can be determined by electrical measurement between the individual magnetic field impulses. Thus such measurement can, for example, be made by measuring the capacitance between the center and the opposed contacts or by means of the amount of excitation which is required in order to deflect the spring towards the closer pole plate in the then existent neutral system. Additionally, there is the possibility of an additional measurement offered by operating and retrodirective excitation of the poled system formed by coupling an external permanent flux circuit in the adjusting device. In such an adjusting method, it should be safeguarded that adjustment is not altered during any subsequent magnetic balancing of the permanent magnet. In this it can be advantageous to allow the demagnetized fields to have an application vertically to the privileged direction of the permanent magnet.

It is even more advantageous to undertake adjustment of the relay after the relay has been completely assembled. In that case operating values of the complete relay can be used as an adjusting criterion. In using this method, it is possible to adjust the operating values particularly precisely by using a combined adjusting and balancing process wherein both the position of the switching element and the balancing of the permanent magnet are to be somewhat simultaneously accomplished. In this system, it is however, desirable to insure that no reciprocal influence occurs between the two processes. It is therefore important that one of the processes can be carried out without altering the final condition of the other. For example, if the permanent magnet is balanced without influencing the switching component adjustment, as can perhaps be accomplished by applying a demagnetizing field having flux lines running parallel to the coil axis, it should be assured that the adjustment is accomplished first and the balancing latter carried out.

Figure 3:
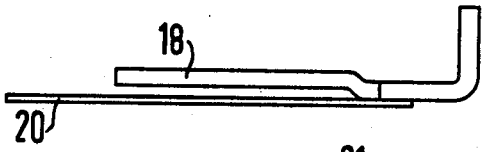
FIGS. 3 and 4 are respectively side and top elevational views of the magnetically adjustable switching element assembly in the form of a spring arm.
Figure 4:
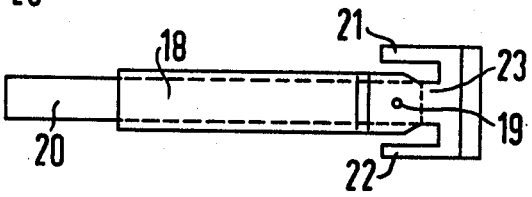

FIGS. 3 and 4 illustrate a somewhat modified adjustment plate. In this construction the adjusting plate can be positioned in the coil body 1 in place of the adjusting plate 8. In this example the switching element 20 is attached at point 19 to the adjusting plate. The plate has 2 laterally spaced bridge members 21 and 22 for enclampment of the adjusting plate into the housing. The adjusting plate is again provided with a theoretical bending point 23 which lies in the area of the point of juncture between the elongated extending ferromagnetic material arm portion and the clamping portion of the attachment plate. It is to be noted that in the embodiment illustrated the majority of the elongated portion of the attachment plate is offset so as to lie spaced relation to the switching element 20.

Figure 5:
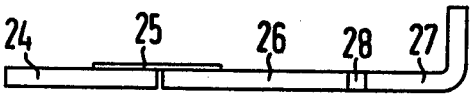
FIGS. 5 and 6 are views similar to FIGS. 3 and 4 illustrating a magnetically adjustable rigid armature.
Figure 6:
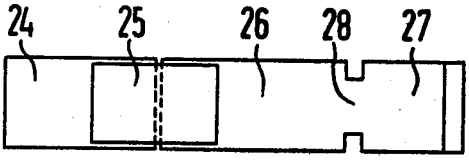
Figure 7:
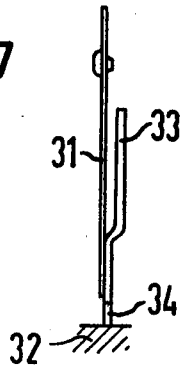
FIG. 7 is a view illustrating a magnetically adjustable contact spring.

FIGS. 5 and 6 illustrate a rigid armature system wherein a rigid armature member 24 is used in place of the spring switching elements of the prior embodiments. The armature can be connected to a magnetic core 26 through the intermediary of a plate member 25 functioning as a flat leaf spring. In this example, the core 26 is simultaneously utilized to provide the adjustment plate. A theoretical bending point 28 is provided between the clamping area 27 used for seating the core 26 in the coil body and the adjusting plate portion 26. In this construction adjustment of the relay can again be provided by means of magnetic deformation of the adjusting plate 26 which is suitably sized to be properly influenced by the magnetic flux lines. The simultaneous usage of a ferromagnetic member as a magnetic core and as the adjusting plate is therefore possible An additional embodiment is illustrated in FIG. 7. In this construction the switching component is a spring member similar to the embodiments of FIGS. 3 and 4 but is, however, a contact making spring 31. This spring is not directly clamped to the carrier 32 but rather is clamped through the intermediary ferromagnetic plate 33. The plate can then function as an adjusting plate deformable by application of a magnetic field in order to make a contact adjustment. Again a theoretical bending point 34 is advantageously provided at a weak point in the cross section of the plate 33.

Although the teachings of my invention have herein been discussed with reference to specific theories and embodiments, it is to be understood that there are by way of illustration only and that others may wish to utilize my invention in different designs or applications.

I claim as my invention:

1. In an electromagnetic relay having a switching element mounted within the relay and resiliently movable therein having a free end which cooperates with at least one other component of the relay to provide a switching effect and an attachment end, the improvement of the switching element having its attachment end mounted to an elongated ferromagnetic adjustment plate, the switching element being resiliently movable with respect to the adjustment plate, the adjustment plate having a clamping joint of attachment to a body of the relay, and the adjusting plate being bendable with respect to the clamping point, the adjusting plate being provided with a theoretical bending point intermediate its clamping point and the point of attachment of the switching element.

2. A relay according to claim 1 wherein the adjusting plate is positioned essentially parallel to the switching element with the attachment end of the switching element attached to the adjusting plate adjacent the adjusting plate clamping point.

3. A relay according to claim 2 wherein the clamping point is adjacent an end of the adjusting plate.

4. A relay according to claim 1 wherein the switching element is in proximate relation to a free end of the adjusting plate spaced from the clamping point and is attached thereto through the intermediary of a resilient member.

5. A relay according to claim 3 wherein the adjusting plate is provided with a theoretical bending point intermediate its clamping point and the point of attachment of the switching element.

6. A relay according to claim 4 wherein the adjusting plate is provided with a theoretical bending point intermediate its clamping point and the point of attachment of the switching element.

7. A relay according to claim 1 wherein the adjusting plate is formed of a material having a spring bending resistance approximately that of soft iron.

8. A relay according to claim 7 wherein the switching element is formed of spring material.

9. A relay according to claim 4 wherein the switching element is formed as a rigid armature and is attached to the adjusting plate through the intermediary of a flat spring.

10. A relay according to claim 1 wherein the switching element functions an an armature contact and is positioned within the interior of a coil body of the relay.

11. A method of adjusting a relay which consists of the steps of forming a relay body, providing a switching element, attaching one end of the switching element to an elongated ferromagnetic adjusting plate at a mounting point, clamping the adjusting plate to the relay body, applying a magnetic field to the adjusting plate with the magnetic lines of flux positioned at an angle of between 0° and 90° relative to the longitudinal axis of the adjusting plate, deforming the adjusting plate by individual magnetic field impulses, providing a weakened cross section bending point for said adjusting plate between a switching element point of attachment and an adjusting plate relay body clamping point.

12. A method according to claim 11 wherein the angle between the magnetic flux lines and the longitudinal axis of the adjusting plate lies within the range of 75° to 90°.

13. A method according to claim 12 wherein the magnetic field is applied in such a manner that a permanent magnet associated with the relay is magnetized by the magnetic field impulses used for deforming the adjusting plate.

14. A method of adjusting a relay which consists of the steps of forming a relay body, providing a switching element, attaching one end of the switching element to an elongated ferromagnetic adjusting plate at a mounting point, clamping the adjusting plate to the relay body, applying a magnetic field to the adjusting plate with the magnetic lines of flux positioned at an angle of between 0° and 90° relative to the longitudinal axis of the adjusting plate, deforming the adjusting plate by individual magnetic field impulses, providing a weakened cross section bending point for said adjusting plate between a switching element point of attachment and an adjusting plate - relay body clamping point.

* * * * *